United States Patent [19]

Hsu et al.

[11] 4,312,745

[45] Jan. 26, 1982

[54] NON-PUFFING PETROLEUM COKE

[75] Inventors: Harry L. Hsu, Johnson City; Lloyd I. Grindstaff, Elizabethton, both of Tenn.; Mack P. Whittaker, Stamford, Conn.

[73] Assignee: Great Lakes Carbon Corporation, New York, N.Y.

[21] Appl. No.: 135,716

[22] Filed: Mar. 31, 1980

Related U.S. Application Data

[63] Continuation-in-part of Ser. No. 8,839, Feb. 2, 1979, abandoned.

[51] Int. Cl.[3] ..... C10G 9/14

[52] U.S. Cl. ..... 208/125; 201/20; 208/126; 208/131

[58] Field of Search ..... 208/125, 126, 131; 201/20

[56] References Cited

U.S. PATENT DOCUMENTS 3,873,427 3/1975 Long et al. ..... 201/17
4,140,623 2/1979 Sooter et al. ..... 208/131

FOREIGN PATENT DOCUMENTS 733073 7/1955 United Kingdom .

*Primary Examiner*—Delbert E. Gantz
*Assistant Examiner*—William Leader
*Attorney, Agent, or Firm*—Adrian J. Good

[57] ABSTRACT

Very fine particle size chromic oxide is dispersed in a high sulfur petroleum coker feedstock before or during delayed coking to produce a needle coke with low CTE and negligible puffing on heating to the temperature of graphitization.

10 Claims, 1 Drawing Figure

NON-PUFFING PETROLEUM COKE

This application is a continuation-in-part of Ser. No. 8,839, filed Feb. 2, 1979, and now abandoned.

DESCRIPTION

BACKGROUND OF THE INVENTION

Electrode grade graphite is manufactured from a commercial grade of coke having an acicular, anisotropic microstructure called needle coke, see U.S. Pat. No. 2,775,549 to Shea, Dec. 25, 1956, Cl. 201-42, made by delayed coking of certain petroleum residues under specific conditions of heat and pressure. To produce graphite from such coke, it is necessary to heat it to a temperature in the range of 2000°-3000° C., which has the dual function of supplying energy for the conversion of the carbon in the coke to the graphitic crystalline form and of volatilizing impurities. When carbon bodies made from such cokes are heated at temperatures in the vicinity of 1000°-2000° C., various sulfur-containing compounds decompose, attended by a rapid and irreversible expansion of the carbon body. This phenomenon is termed "puffing". During the production of graphite articles, particularly high performance graphite electrodes, puffing is extremely undesirable as it may destroy the structural integrity of the piece and render it marginal or useless for its intended purpose.

Puffing of a carbon article made from high sulfur cokes generally starts at about 1500° C., and may result in a volumetric expansion of as much as 25%. It is not simply an elastic expansion but should be characterized as an inelastic, irreversible expansion.

The generally accepted explanation of the puffing phenomenon is that in acicular needle cokes with a relatively large amount of sulfur, sulfur atoms are bonded to carbon atoms by covalent bonds, either in carbon ring structures or linking rings. These bonds are less stable at high temperatures than the carbon-to-carbon bonds. On heating, the carbon-sulfur bonds rupture, the sulfur is freed, then reacts with hydrogen to form hydrogen sulfide. The simultaneous rupture of these bonds and evolution of hydrogen sulfide and other sulfur containing materials causes the physical expansion called puffing.

Puffing has been avoided in the past by using coke made from petroleum residues low in sulfur content. This approach is of only limited utility at present since the principal petroleum crudes currently in use have high sulfur contents, and the cokes made from their residues such as decant oil from catalytic cracking or thermal tar, will normally exhibit an undesirable degree of puffing.

Another approach to elimination or alleviation of the puffing problem in manufacture of graphite articles has been by the use of additives. These additives have usually been added during the mixing stage when various sizes and grades of coke particles are mixed, before being wetted with pitch binder, formed into the desired shape, baked at an intermediate temperature and graphitized at high temperatures. Additives have included primarily metal salts and oxides, as disclosed in British Pat. No. 733,073, Greenhalgh, July 6, 1955, Cl. 90 b; French Pat. No. 1,491,497, Gillot et al., Aug. 11, 1967, Cl. C 01 b; French Pat. No. 2,035,273, Continental Oil, Dec. 18, 1970, Cl. C 10 b 57; U.S. Pat. No. 3,642,962, Wallouch, Feb. 15, 1972, Cl. 201-17; U.S. Pat. No. 3,563,705, Grindstaff et al., Feb. 16, 1971, C. C 01 b 31/04, Cl. 423-375; U.S. Pat. No. 3,842,165, Grindstaff et al. Oct. 15, 1974, Cl. C 01 b 31/04, Cl. 264-29.1; and U.S. Pat. No. 3,338,993, Juel et al. Aug. 29, 1967, Cl. 106-56.

The patents above disclose the use of iron, sodium, chromium, nickel, cobalt, boron, aluminum, titanium, calcium, zirconium, manganese, magnesium, barium and strontium compounds as puffing inhibitors. Some compounds of this group are in general usage and of these a choice is naturally made based upon the effectiveness as a puffing inhibitor and upon other properties of the graphite article such as electrical resistivity, tensile strength, modulus of rupture, modulus of elasticity, coefficient of thermal expansion, and cost.

Of the above, French Pat. No. 1,491,497 discloses the use of chromium oxide at 0.2-5% in a mixture with coke and a binder as a catalyst, enabling graphitization to occur at temperatures in the range of 1200°-2000° C.

French 2,035,273 discloses a low sulfur coke produced by the addition of 0.3-5% of sodium carbonate to the coking stream mixture and subsequent hydrogenation of the coke at high temperature.

British 733,073 discloses the use of oxides of chromium, iron, copper, or nickel incorporated in the grinding stage of coke, mixed with pitch, shaped, baked at 1200° C., and graphitized at 2500°-2800° C.

U.S. Pat. No. 3,563,705 discloses the use of mixtures of iron or calcium compounds with small amounts of titanium or zirconium compounds as puffing inhibitors incorporated into the coke-binder mixture.

U.S. Pat. No. 3,338,993 discloses the use of calcium, magnesium, strontium, and barium fluorides as puffing inhibitors with raw or calcined coke and binder, mixed, shaped, baked and graphitized.

U.S. Pat. No. 3,642,962 discloses the use of 1-3% calcium cyanamid or calcium carbide as desulfurizing agents and puffing inhibitors, mixed with raw coke prior to calcining.

U.S. Pat. No. 3,873,427, Long, issued Mar. 25, 1975, Cl. 201/17, discloses the addition of metallic chloride and ferruginous material for desulfurization of coke.

U.S. Pat. No. 4,043,898, Kegler, issued Aug. 23, 1977, Cl. 208/50, discloses delayed coking of selected feedstocks to produce needle cokes.

At present, the most common methods of the above are those using iron oxides mixed dry in the coke-pitch binder blend as puffing inhibitors. These are effective puffing inhibitors but must be used with caution, as their use tends to increase the coefficient of thermal expansion or CTE, of the finished product, to an undesirable level.

The coefficient of thermal expansion (CTE), which is conventionally expressed in in./in./°C. or cm./cm./°C., is also of vital importance in the production of graphite for certain applications. Electrodes for electric furnace melting of steel must have a low CTE to avoid excessive differential expansion at operating temperatures and the resultant spalling, which in turn causes excessive consumption of the electrode in operation. Other applications requiring dimensional stability at high temperatures are well-known although of somewhat less economic importance.

In general, the addition of any foreign material to a graphitizing carbonaceous mix will have, in addition to its desired effect, such as puffing inhibition, the effect of increasing the CTE of the graphite body.

A needle coke is distinguished by its physical structure when microscopically examined, showing long needle-like acicular particles. Such cokes, to be suitable for manufacture of graphite electrodes to be used in ultra-high powered electric steel furnaces, should have a graphite CTE characteristic of less than $5+10^{-7}/°C$. measured over the range of 0°-50° C. Needle cokes for lower powered electric steel furnaces may have a graphite CTE characteristic of as much as $7\times10^{-7}/°C$. over the 0°-50° C. range.

The cokes or blends of cokes must be thoroughly mixed with the puffing inhibitor to avoid the difficulties present in making uniform homogeneous blends and to thoroughly coat the particles, which are often as much as 7 mm. in diameter. Both of these difficulties can lead to non-uniform dispersion of the inhibitor and to puffing, even though there is sufficient inhibitor present in the total mix to prevent puffing. This non-uniformity is particularly troublesome when operating under the newer type of graphitization processes, which raise the temperature of the carbon bodies (i.e. electrodes) at a much higher rate than the older processes. The combination of high sulfur with high rate of temperature rise exacerbates the problem and requires undesirably slow heating rates to overcome puffing.

It should be emphasized that overcoming the puffing problem becomes increasingly more difficult in the larger graphite electrode sizes (above 20 in. ((51 cm.)) diam) because in such sizes, larger particles of coke are used. Since the puffing inhibitor only coats the surface of the particles, the coke surface area to inhibitor weight ratio decreases, for a given weight addition ratio, giving a higher concentration of inhibitor on the coke particle surfaces for the larger particle blends. Thus a large amount of the inhibitor is at relatively greater distance from the centers of the coke particles in the larger coke particle mixes as opposed to the smaller particle mixes used in smaller electrodes. Migration of the inhibitor into the centers of the large particles becomes progressively more difficult and less effective as the coke particles increase in size.

The puffing problem is further increased with the rate of graphitization of the carbon bodies. Optimum distribution of the inhibitor throughout the structure of the carbon body to be graphitized is essential as the degree of puffing for any coke particle blend is highly rate sensitive, being directly related to the rate of temperature increase during the graphitization cycle. Thus, the figures in certain of the examples given will show a much higher dynamic puffing at a 14° C./min. temperature rise than for a 5° C./min. rise.

The amount of puffing for any given coke-inhibitor blend could be expressed as a proportionality in the general form:

| | |
|---|---|
| $DP = \frac{K(S,P,\Delta T)}{I}$ | where S = sulfur content of coke |
| where DP = dynamic puffing | P = mean particle size<br>ΔT = rate of temperature increase<br>I = amount of inhibitor<br>K = proportionality factor |

Thus it may be seen that increases in sulfur content, particle size, and temperature rise will increase puffing, while an increase in the inhibitor level will decrease puffing.

SUMMARY OF THE INVENTION

A petroleum coker feedstock which would normally produce a puffing coke due to its high sulfur content is rendered non-puffing by the addition of an effective amount of a chromium compound, preferably chromic oxide, to the feedstock as a fine particle size powder.

The chromic oxide may be pre-dispersed in a high concentration in a small quantity of the feedstock (fresh feed or coker furnace feed) or compatible material miscible with the feedstock or dispersed in the total coker stream and added either batchwise to a batch type coker, continuously to the main stream in a delayed coker, or near the top or side of a delayed coker, as in the case of anti-foam additives, while the coker stream is admitted into the coker at or near the bottom of the unit.

The use of a fine particle size chromic oxide of 100% less than 5 micron and 70% less than 2 micron diameter, predispersed in a portion of the feedstock, insures that the final product will be a homogeneous coke with chromic oxide uniformly distributed throughout.

A current of inert gas or steam bubbled slowly through the hydrocarbons in a batch type coker during the run aids in keeping the chromic oxide in suspension without significantly increasing the CTE of the finished product. For a description of delayed coking, see R. J. Diwoky, *Continuous Coking of Residuum by the Delayed Coking Process,* Refiner and Natural Gasoline Manufacturer, Vol. 17, No. 11, Nov. 1938. The $Cr_2O_3$ dispersion may be injected through the anti-foam injector ports or a special fitting.

Many chromium compounds may be used, and the present disclosure is not meant to limit the scope of the invention. $Cr_2O_3$, for example is the final product of calcination of numerous chromium compounds, e.g., hydrated Cr (III) oxide, Cr (III) nitrate, $[Cr(NH_3)_6](NO_3)_3$, and other complex compounds and salts such as $(NH_4)_2Cr_2O_7$. $Cr_2O_3$ is manufactured commercially by ignition of compounds such as metal chromates and bichromates with reducing agents and may be produced in situ by reduction with the coke.

The reactive species may be elemental chromium, produced by reduction of the $Cr_2O_3$ by the coke during the graphitization process, or by dissociation occurring at or below its melting point (2275° C.), similarly to the production of ferrochromium alloys by reduction of chromite ore with coke in a submerged arc furnace.

The mode of operation of $Cr_2O_3$ in inhibiting puffing has the most likely hypothesis of the reaction with a sulfur compound to form $Cr_2S_3$ in a scavenging reaction, the sulfide later decomposing at a higher temperature in a slower reaction.

In general the use of any of the additives listed above, when added to a coke particle-pitch binder mix, will lower the extent of puffing, but at the same time significantly increase the CTE, of the graphite bodies made from such cokes. We have found that the use of chromium oxide dispersed in the coker feedstock when coking in a delayed coker gives an unexpected advantage in that it controls puffing of the coke while increasing the CTE only to a smaller degree (or in some instances not at all), when compared to the CTE of a graphite body in which the puffing has been eliminated by adding the same additive to the electrode mix by the conventional dry-mix practice.

CTE of the graphitized coke was determined by preparing small 5/8"×5" (1.6×12.7 cm.) electrodes by the procedure disclosed in U.S. Pat. No. 2,775,549, (except for calcination of the coke to 1250° C.), and measuring their elongation over the temperature range of 0° to 50° C.

DESCRIPTION OF THE DRAWING

The drawing is a schematic illustration of apparatus used in carrying out the process.

Figure 1:
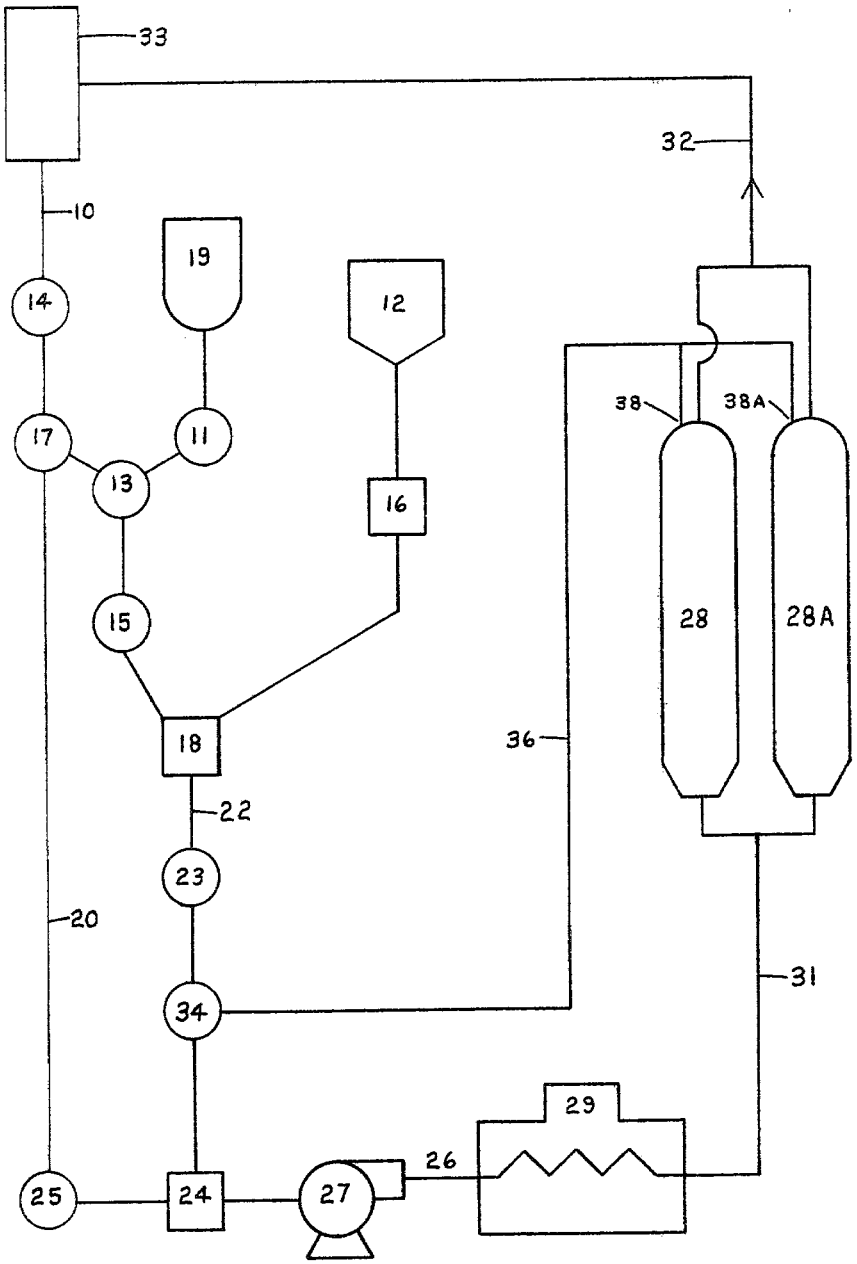
In FIG. 1 a decant oil, the fractionater tower bottoms from a catalytically cracked gas oil fraction, also termed slurry oil, or other equivalent hydrocarbon residue, is conveyed from the fractionater 33 through line 10 and meter 14 to diversion valve 17, where a portion of the feedstock is diverted through valve 13, and meter 15 to disperser 18. Simultaneously a portion of chromic oxide 12 is weighed in scale 16 and conveyed to disperser 18 where it is dispersed in the feedstock to a specific concentration by weight. Alternately a compatible liquid and additives from supply 19 are metered through valve 11 to valve 13 and meter 15 to disperser 18. The chromic oxide is dispersed and discharged through line 22 and meter 23 to valve 34, line 36 and injection ports 38 and 38A or alternately to mixer 24 where it is mixed with the main portion of the feedstock coming through line 20 and meter 25, to the exact proportion desired. The chromic oxide concentrate mixed with the feedstock is then conventionally delay coked. The overheads are taken off through line 32 and sent to the fractionator 33.

In the above flowsheet, 18 is the disperser which may be any of several types of equipment well known in the art, preferably a high shear or colloid mill. Alternately, a sand or ball mill could be used.

In practice, a dispersion of approximately 3–50% by wt. of chromic oxide in the feedstock is used as a concentrate.

The chromic oxide dispersion and feedstock are metered in the correct proportions to give a concentration of approximately 0.05–0.5 wt. % $Cr_2O_3$ in the feedstock.

At the operating temperatures the viscosity of the feedstock is extremely low and some means is necessary to minimize settling and a concentration of the chromic oxide in the lower portion of the coker during batchwise coker operation. We have found that by the introduction of a small flow of inert gas bubbled up from the bottom of the coker drum, the chromic oxide is maintained in a uniform suspension without significantly raising the CTE of the finished product or lowering the acicular crystal content of the coke. It is preferable to add the $Cr_2O_3$ at or near the top of a commercial delayed coker while admitting preheated coker feed through or near the bottom of the coker.

The following are examples of specific methods of practicing the invention:

EXAMPLE 1

The micronized puffing inhibitor, chromic oxide, was mixed with samples of a fresh feed decant oil coker feedstock, at 0.1 wt. % level in a high speed blender for about 5 minutes. The mixtures were coked under identical conditions in 4 liter resin flasks.

In an insulated glass resin flask, an inert gas at the rate of 0.16 SCFH/kg (4.5 l./hr./kg.) was bubbled up from the bottom of the coking pot to keep the $Cr_2O_3$ uniformly dispersed in feedstock. The following time-temperature cycle was used:

| Temperature | Elapsed Time | Rate ΔC°/hr |
|---|---|---|
| Room to 350° C. | 3 hours | 110 |
| 350–450° C. | 4.5–5 hours | 20 |
| 450° C. | 16 hours | — |
| 450–530° C. | 4.0–4.5 hours | 20 |
| 530° C. | 1 hour | — |
| 530° C.-RT | Cool-down, power off | |

Dynamic puffing (DP) of the cokes was then determined by the method below and compared with uninhibited samples, and with samples inhibited in the normal manner with dry-mixed iron oxide. The coke samples had 50% <200 mesh (78 mesh/cm.) particles and 100% <65 mesh (26 mesh/cm.) particles.

DP was measured by taking representative samples by the method of ASTM D346-35, crushing, mixing 100 g coke and 25 g pitch, and molding plugs at 12,500 psi (879 kg./cm.$^2$). The plugs were measured by micrometer and placed in a dilatometer. The temperature was raised to 1200° C. over a period of 50±10 min. The test was run at a temperature increase of 5° or 12°–16° C./min. over the 1200°–2900° C. range, with measurements taken every five minutes. The reported DP (dynamic puffing) is the maximum percentage of elongation (or shrinkage) measured. All of the DP's below were at 14° C./min. rise except as noted.

| Inhibitor Added to Feedstock | Coke Yld. % | Coke Properties: Ash % | S % | CTE × $10^{-7}$/°C.** pph $Fe_2O_3$* 0 | ½ | DP, % Δ L*** pph $Fe_2O_3$* 0 | ½ |
|---|---|---|---|---|---|---|---|
| 0 | 23.3 | 0.01 | 1.17 | 3.0 | — | 6.8 | — |
| 0 | 23.3 | 0.01 | 1.17 | — | 3.8 | — | 1.7 |
| 0.1% $Cr_2O_3$ | 22.6 | 0.46 | 1.07 | 3.8 | — | −1.5 | — |

*(Iron oxide dry-mixed into the coke)
**(Coefficient of Thermal Expansion over the range of 0°–50° C. × $10^{-7}$/°C., ⅝" × 5" ((1.6 × 12.7 cm.)) sample, 10 min. time)
***(Dynamic Puffing over the range of 1200°–2900° C.)

It is clear that micronized chromic oxide was found to be highly effective. The addition of micronized chromic oxide to the feedstock inhibited puffing of the resulting coke. While exhibiting lower DP, the resulting coke had a CTE (~0.5% ash which is essentially chromic oxide) equal to that of the coke inhibited with an equal amount of iron oxide in a dry blend.

EXAMPLE 2

Identical to Example 1 except that 0.05 wt. % micronized chromic oxide was added to the feedstock prior to coking with the results shown below:

| Inhibitor Added to Feedstock | Coke Yld. % | Coke Properties: Ash % | S % | CTE × $10^{-7}$/°C. pph $Fe_2O_3$* 0 | ¼ | DP, % Δ L pph $Fe_2O_3$* 0 | ½ |
|---|---|---|---|---|---|---|---|
| 0 | 23.3 | 0.01 | 1.17 | 3.0 | 3.6 | 6.8 | 1.7 |
| 0.05% $Cr_2O_3$ | 21.8 | 0.25 | 1.17 | 3.0 | — | 1.5 | — |

* dry blend

The above data indicate that the addition of micronized chromic oxide to the coker feedstock resulted in a coke (0.25% ash) with a lower CTE and a lower puffing than that of the coke conventionally inhibited with corresponding amounts of iron oxide, respectively.

EXAMPLE 3

Micronized chromic oxide (0.1 wt. %) was added to another sample of furnace feed decant oil coker feedstock. The mixture was coked in the same manner described in Example 1:

| Inhibitor Added to Feedstock | Coke Yld. % | Coke Properties: Ash % | S % | CTE × $10^{-7}$/°C. pph $Fe_2O_3$* 0 | 1 | DP, % Δ L pph $Fe_2O_3$* 0 | 1 |
|---|---|---|---|---|---|---|---|
| 0 | 26.4 | <0.01 | 0.97 | 3.3 | 3.5 | +2.3 | −1.8 |
| 0.1% $Cr_2O_3$ | 25.6 | 0.35 | 0.98 | 2.6 | — | −1.3 | — |

*dry blend

The above data showed that micronized chromic oxide (0.1 wt. %) added to the feedstock inhibited puffing of the resulting coke without adversely affecting the CTE of the coke. In fact, the CTE of the resulting coke (0.35% ash) was less than that of the coke with no inhibitor or conventionally inhibited with 1 pph iron oxide.

EXAMPLE 4

Micronized chromic oxide (0.075 wt. %) was dispersed in a sample of slurry oil coker feedstock. The mixture was then coked using the procedure of Example 1. The properties of the coke were determined for comparison with that of the control coke from this oil with and without the addition of micronized chromic oxide.

| Inhibitor Added to Feedstock | Coke Yld. % | Coke Properties: Ash % | S % | CTE $10^{-7}$/°C. | DP, % Δ L pph $Cr_2O_3$* 0 | 1 |
|---|---|---|---|---|---|---|
| 0 | 16.3 | 0.06 | 1.29 | 2.5 | 8.5 | — |
| 0 | 16.3 | 0.06 | 1.29 | — | — | 0 |
| 0.075% | 16.7 | 0.51 | 1.36 | 2.2 | 0.7 | — |

*Dry blend

It is seen from the above comparison that micronized chromic oxide added to the feedstock resulted in a coke (0.51% ash) with a substantial reduction in puffing without adversely affecting the CTE of the coke. In fact, the CTE of the coke made in the presence of chromic oxide was slightly lower than that from the original untreated feedstock.

EXAMPLE 5

Micronized chromic oxide was added conventionally by dry mixing to a coke sample made from the decant oil of Example 1, to determine its relative effectiveness in a dry blend vs. addition to the coker feedstock, to an equal $Cr_2O_3$ concentration on the coke basis with respect to puffing inhibition. Results were as follows:

| Inhibitor Added to Feedstock | Coke Properties: Ash % | S % | CTE $10^{-7}$/°C. | DP, % Δ L pph $Cr_2O_3$ 0 | ½* |
|---|---|---|---|---|---|
| 0 | 0.01 | 1.17 | 3.0 | — | 0.1 |
| 0.1% $Cr_2O_3$ | 0.46 | 1.07 | 3.8 | −1.5 | — |

*dry blend

The above data clearly indicate that micronized chromic oxide is more effective in the coker feedstock than when used conventionally as a puffing inhibitor.

Examples 1-5 above were made in 4 liter resin flasks and were agitated by nitrogen bubbling for one minute when the temperature reached 420° C. No settling of chromic oxide was observed.

EXAMPLE 6

Large batch cokings were made on samples of a different fresh feed batch of decant oil feestock from the same supplier as in No. 1, with results as follows:

| | Wt. | % $Cr_2O_3$ added to Feed-stock | Coke Yield | Coke Properties: CTE $10^{-7}$/°C. | DP, % Δ L |
|---|---|---|---|---|---|
| Run No's 2, 3, 7 composite | 991# (450 kg.) | 0 | 21.2% | 3.2 | 7.8 |
| Run No's 4, 5, 6, 8 composite | 1303 (591 kg.) | 0.11 | 22.2 | 4.3 | 0.7 |
| Run No's 10, 11, 12 composite | 1028 (466 kg.) | 0.15 | 21.2 | 5.1 | 0.1 |

All of the above, except #5 were bubbled with $N_2$ through the 400°-440° C. temperature range at the rate of 2 C.F.M. (57 l./min.).

The composite samples were calcined at about 1300° C. for 30 min. with calcined coke yields of about 75%. The properties of the calcined cokes were as follows:

| Sample No. | Inhibitor % | Density g/cc | Ash % | CTE $10^{-7}$/°C. | DP, % Δ L |
|---|---|---|---|---|---|
| 1894-20A | 0 | 2.10 | 0.24 | 3.9 | 1.1 |
| 1894-20B | 0.11 | 2.14 | 0.81 | 4.6 | 0.3 |
| 1894-20C | 0.15 | 2.12 | 1.23 | 4.3 | 0.1 |

The values for the raw and calcined cokes were in good agreement, except for the uninhibited calcined sample, which had a lower than expected dynamic puffing, which ordinarily is similar to the puffing shown by the raw coke exam.

EXAMPLE 7

In a test to determine the appropriate amount of $Cr_2O_3$ to be added to the feedstock and the amount of agitation, an automatic coker was charged with 10 kg of another lot of the previously mentioned decant oil from Example 6 and varying amounts of $Cr_{O3}$ were added to the feedstock. The batches were agitated by bubbling with 2 C.F.H. (57 l./hr.) $N_2$ through the temperature interval from 390°-440° C., which at the temperature rise of 5°/C./hr, took 10 hrs. Results are tabulated below:

| Run No. | % $Cr_2O_3$ added to feedstock | Coke Yield | Ash Distribution Top | Mid | Bot. | Coke Properties CTE $10^{-7}$/°C. | DP % Δ L |
|---|---|---|---|---|---|---|---|
| 1897-21 | 0 | 31.1% | 0.03% | 0.01% | 0.02% | ~0.1 | 14.9 |
| 1897-22 | 0.1 | 31.8 | 0.34 | 0.28 | 0.33 | 2.8 | 4.4 |
| 1897-35 | 0.2 | 28.0 | 0.67 | 0.66 | 0.84 | 4.4 | <−0.5 |
| 1897-20 | 0.4 | 31.6 | 1.19 | 1.26 | 1.28 | 4.1 | <−0.1 |

Low CTE values characterize graphite bodies made from high sulfur needle cokes because such bodies puff considerably (see 1897-21) at temperatures between 1200°-2900° C. due to the high sulfur content. The cokes above showed no puffing when 0.2% $Cr_2O_3$ was added to the feedstock while maintaining a CTE within the level of a high quality coke.

EXAMPLE 8

The same feedstock in Example 7 was processed in a 4 l. resin flask with 0.5 C.F.H. (14 l./hr.) $N_2$ bubbled through the system during the temperature interval of 400°-450° C. while the temperature was raised at a rate of 20°/hr, for a period of 2.5 hrs. Results of these tests are shown below:

| Run No. | $Cr_2O_3$ Add. to feedstock | Coke Yield | Ash Top | Ash Bot. | CTE $10^{-7}$/°C. | DP % Δ L |
|---|---|---|---|---|---|---|
| 1959-7/10 | 0.15% | 26.1% | 0.56% | 0.58% | 3.1 | 0.3 |
| 1959-3/5 | 0.2 | 24.5 | 0.82 | 0.89 | 3.8 | <−0.7 |

It is evident here also that a high quality coke with low CTE and puffing has been made.

EXAMPLE 9

In this test, coke samples produced in Examples 7 and 8 above were mixed in a standard commercial mix of coke with particles up to 3 mesh (1.2/cm.) with coal tar pitch binder, forming pieces by molding, baked to 720° C., then graphitized at two different upheat rates of 5° and 14° C./min., with results showing dynamic puffing over the range of 1200°-2900° C. as follows:

| Coke | $Cr_2O_3$ Added to Feedstock | % $Cr_2O_3$ in coke (Composite) | DP, % Δ L 5° C./min. | DP, % Δ L 14° C./min. |
|---|---|---|---|---|
| 1897-21 | 0 | 0 | 9.4 | 21.0 |
| 1897-22 | 0.1 | 0.34 | 4.5 | 7.0 |
| 1859-7/10 | 0.15 | 0.67 | 0.8 | 1.6 |
| 1897-20 | 0.4 | 1.25 | 0.1 | 0.4 |

The improvement due to $Cr_2O_3$ in elimination of puffing at the higher upheat rate of 14° C./min. is particularly evident in the above data and in the attainment of protection against puffing at a low inhibitor level.

EXAMPLE 10

Blends of smaller particle sized (up to 6 mesh ((2.4 mesh/cm.))) cokes made in two different cokers from the same feedstock as in Example 7, mixed with coal tar pitch binder and molded as in Example 9, were tested at the two upheat rates, with the following results:

| Run No. | % $Cr_2O_3$ Added to Feedstock | Coke % Yield | % Ash in Coke | CTE $10^{-7}$/°C. | DP, % Δ L 5° C./min. | DP % Δ L 14° C./min. |
|---|---|---|---|---|---|---|
| 1897-35 (Automatic Coker) | 0.2 | 28 | 0.73 | 4.4 | 0.6 | 0.8 |
| 1959-3/5 (Resin Flask) | 0.2 | 24.5 | 0.92 | 3.8 | 0.2 | 0.5 |

(The higher ash content of the sample prepared in the resin flask is probably due to a slight pickup of silica from the flask.) The favorable results obtained at the high upheat rates are notable.

EXAMPLE 11

Chromite ore ground to −325 mesh (125 mesh/cm.) was dispersed in the same decant oil coker feedstock and the mixture was coked, in the same fashion as in Example 1 above. The ore had the following analysis:

$Cr_2O_3$-36%
$Al_2O_3$-30%
$Fe_2O_3$-14%
inert-20%
Particle size-<325 mesh (125 mesh/cm.)

The results were as follows:

| % Ore Added to Feedstock | CTE $10^{-7}$/°C. | DP, % Δ L |
|---|---|---|
| 0 | 2.9 | 8.3 |
| 0.1 | 3.8 | 1.3 |
| 0.2 | 3.2 | 0.5 |
| 0.3 | 5.7 | <−2.3 |

The data shows that chromite ore as the source of chromium is effective as a puffing inhibitor.

EXAMPLE 12

In this run, two feedstocks with very high sulfur levels were treated with $Cr_2O_3$ and coked by the standard method in Example 1, and compared with untreated control samples. Results were:

| Feedstock | % $Cr_2O_3$ Added to Feedstock | Coke Properties Ash % | S % | CTE $10^{-7}$/°C. | DP, % Δ L |
|---|---|---|---|---|---|
| Clarified Oil | 0 | 0.10 | 2.30 | 3.0 | 4.4 |
| | 0.4 | 1.35 | 2.34 | 7.3 | 0.2 |
| Decant Oil | 0 | 0.26 | 2.84 | 0 | 12.9 |

-continued

| Feedstock | % $Cr_2O_3$ Added to Feedstock | Coke Properties Ash % | S % | CTE $10^{-7}$/°C. | DP, % Δ L |
|---|---|---|---|---|---|
| | 0.4 | 1.80 | 2.84 | 8.3 | 0.5 |

The CTE of the cokes produced were excessive for premium needle cokes to be used in making ultra high power graphite electrodes. The very high sulfur contents of the oils necessitated the high level of $Cr_2O_3$ addition, which reduced puffing to a satisfactory level, but increased the CTE to a point above the acceptable range for such an application. The cokes were suitable, however, for making graphite bodies and electrodes for less severe applications.

EXAMPLE 13

Two samples of decant oils from another source were coked and tested as in Example 1 with the following results:

| Sample No. | % $Cr_2O_3$ Added to Feedstock | Coke Properties Ash % | S % | CTE $10^{-7}$/°C. | DP, % Δ L |
|---|---|---|---|---|---|
| 893 | 0 | 0.18 | 1.05 | 1.6 | 6.9 |
| 893 | 0.1 | 0.63 | 1.14 | 2.9 | 0 |
| 363 | 0 | 0.03 | 1.08 | 1.5 | 6.2 |
| 363 | 0.1 | 0.50 | 1.09 | 2.4 | 0 |

It is evident that the above cokes have desirably low CTE and dynamic puffing characteristics.

EXAMPLE 14

The same fresh feed used in Example 7 was tested as in Example 1 using the inhibitor at a higher level of addition, with the following results:

| Inhibitor Added to Feedstock | Coke Properties CTE $10^{-7}$/°C. | DP, % Δ L |
|---|---|---|
| 0 | 2.9 | 8.3 |
| $Cr_2O_3$ (0.2%) | 4.2 | 0 |

The utility of $Cr_2O_3$ in the above test is evident.

In the above examples, it was noted that bodies produced from the cokes amenable to inhibition displayed expansion maxima at temperatures in the region of 2500°–2600° C. Another advantage in the use of $Cr_2O_3$ as compared to other inhibitors is shown in the improvement in secondary puffing, wherein the expansion curve for $Cr_2O_3$ inhibited cokes turns downward at temperatures of 2700° C. and higher, while the $Fe_2O_3$ inhibited cokes show a continued expansion at this temperature.

Some feedstocks may well need and be beneficially treated with $Cr_2O_3$ additions of as much as 0.5%, resulting in a 2% ash level of $Cr_2O_3$ in the final coke.

The examples above are not shown as limitations but merely samples from the wide variety of petroleum residues currently available.

EXAMPLE 15

During operation of a pilot coker, it was observed that $Cr_2O_3$, when injected into the feed line, had segregated in the bottom in several pockets. Although it is known that space velocity in a commercial coker is much higher than in a pilot coker, it was believed that this might not be sufficient to maintain dispersion of $Cr_2O_3$ uniform from top to bottom. Consequently, during the next run the $Cr_2O_3$ dispersion was injected into the top of the coker through an anti-foam injector port as a 5% dispersion in slurry oil cut back 25% with VM&P naphtha, making the $Cr_2O_3$ concentration 3.75% in the total additive. The resulting ash levels were as follows, from vertical and horizontal sections:

| | Ash % | | Ash % |
|---|---|---|---|
| Top | 0.35 | Outer edge | 0.29 |
| Middle | 0.28 | Outer-mid | 0.28 |
| Bottom | 0.31 | Inter-mid | 0.31 |
| | | Center | 0.34 |
| | | Core | 0.33 |

The calculated ash ($Cr_2O_3$) in the coke was 0.35% on the basis of the injected amount, with these figures showing a uniform distribution of the $Cr_2O_3$ in the coke produced.

Tests for CTE and dynamic puffing confirmed that the coke produced was of excellent quality:

| | CTE × $10^{-7}$/°C. No Additive | 2pph $Fe_2O_3$ | DP No additive %, Δ L |
|---|---|---|---|
| Top | 5.2 | 5.5 | |
| Middle | 5.2 | 5.9 | +0.2% |
| Bottom | 5.3 | 6.7 | |

We claim:

1. In a process for the manufacture of non-puffing needle coke suitable for graphitization by delayed coking of petroleum feedstocks having a level of sulfur content combined molecularly in components of said feedstock sufficiently high enough to contribute to an irreversible volumetric expansion of the coke on heating to a temperature of 1400° C. or higher, the improvement comprising the addition and dispersion of a chromium compound into the feedstock prior to or during coking of the feedstock in a delayed coker, said chromium compound being added in an amount effective to render the coke non-puffing.

2. In a process for the manufacture of non-puffing needle coke suitable for graphitization and having a graphite CTE characteristic of not over $7\times10^{-7}$/°C. over the range of 0° to 50° C. by delayed coking of petroleum feedstocks having a level of sulfur content combined molecularly in components of said feedstock sufficiently high enough to contribute to an irreversible volumetric expansion of the coke on heating to a temperature of 1400° C. or higher, the improvement comprising the addition and dispersion of a finely divided chromium compound into the feedstock prior to or during coking of the feedstock in a delayed coker, said chromium compound being added in an amount effective to render the coke non-puffing.

3. The process of claims 1 or 2 wherein from 0.05 to 0.5% of chromic oxide is added to the feedstock.

4. The process of claims 1 or 2 wherein from 0.05 to 0.5% of chromic oxide is added to the feedstock in the form of a predispersed concentrate of said chromic oxide in a liquid medium, compatible with said feedstock.

5. The process of claims 1 or 2 wherein chromic oxide is used which has a particle size such that 100% of said chromic oxide particles are less than 5 microns and 70% are less than 2 microns in diameter.

6. The process of claims 1 or 2 wherein the chromium compound is added in the form of naturally occuring chromite ore.

7. The process of claims 1 or 2 wherein the chromium compound is dispersed in a portion of the coker feedstock.

8. The process of claims 1 or 2 wherein the chromium compound is selected from the group consisting of the chromium compounds yielding chromic oxide when the coke produced in the delayed coker is subsequently calcined at a high temperature.

9. The process of claims 1 or 2 wherein the chromium compound is selected from the group consisting of hydrated Cr (III) oxide, Cr (III) nitrate, $(NO_3)_3$, $(NH_4)_2Cr_2O_7$, metal chromates and bichromates.

10. In a process for the manufacture of non-puffing needle coke suitable for graphitization and having a graphite CTE characteristic of not over $5\times10^{-7}/°C.$ over the range of 0° to 50° C. by delayed coking from petroleum feedstocks having sulfur molecularly combined in components of said feedstock in sufficient quantity to contribute to an irreversible volumetric expansion on heating to a temperature of 1400° C. or higher, the improvement comprising selecting an effective amount of chromic oxide of particle size less than $5\mu$ ($5\times10^{-6}$ m) to be added to said feedstock in a concentration by wt. of 0.05 to 0.5% of said feedstock, dispersing said chromic oxide in a portion of said feedstock or other compatible material to form a uniform dispersion of said chromic oxide, adding said dispersion to the principal portion of said feedstock through the top of a delayed coker and coking said feedstock.

* * * * *